US009315758B2

(12) United States Patent
Yamaguchi et al.

(10) Patent No.: US 9,315,758 B2
(45) Date of Patent: Apr. 19, 2016

(54) LUBRICATING OIL COMPOSITIONS

(75) Inventors: Elaine S. Yamaguchi, Hercules, CA (US); Kam-Sik Ng, San Lorenzo, CA (US)

(73) Assignee: Chevron Oronite Company LLC, San Ramon, CA (US)

( * ) Notice: Subject to any disclaimer, the term of this patent is extended or adjusted under 35 U.S.C. 154(b) by 107 days.

(21) Appl. No.: 12/286,377

(22) Filed: Sep. 30, 2008

(65) Prior Publication Data

US 2010/0081589 A1 Apr. 1, 2010

(51) Int. Cl.
*C10M 125/00* (2006.01)
*C10M 139/00* (2006.01)

(52) U.S. Cl.
CPC ..... *C10M 125/00* (2013.01); *C10M 139/00* (2013.01); *C10M 2203/1006* (2013.01); *C10M 2203/1025* (2013.01); *C10M 2205/022* (2013.01); *C10M 2205/024* (2013.01); *C10M 2207/021* (2013.01); *C10M 2207/026* (2013.01); *C10M 2207/028* (2013.01); *C10M 2207/142* (2013.01); *C10M 2207/262* (2013.01); *C10M 2209/084* (2013.01); *C10M 2215/042* (2013.01); *C10M 2215/064* (2013.01); *C10M 2215/28* (2013.01); *C10M 2219/044* (2013.01); *C10M 2219/046* (2013.01); *C10M 2219/089* (2013.01); *C10M 2223/045* (2013.01); *C10M 2227/09* (2013.01); *C10N 2210/04* (2013.01); *C10N 2210/06* (2013.01); *C10N 2230/06* (2013.01); *C10N 2230/42* (2013.01); *C10N 2230/43* (2013.01); *C10N 2230/45* (2013.01); *C10N 2240/102* (2013.01); *C10N 2240/104* (2013.01); *C10N 2260/14* (2013.01)

(58) Field of Classification Search
CPC ..... C10M 125/00; C10M 139/00; C10M 2203/1006; C10M 2203/1025; C10M 2205/022; C10M 2205/024; C10M 2207/021; C10M 2207/026; C10M 2207/028; C10M 2207/142; C10M 2207/262; C10M 2209/084; C10M 2215/042; C10M 2215/064; C10M 2215/28; C10M 2219/044; C10M 2219/046; C10M 2219/089; C10M 2223/045; C10M 2227/09; C10N 2210/04; C10N 2210/06; C10N 2230/06; C10N 2230/42; C10N 2230/43; C10N 2230/45; C10N 2240/102; C10N 2240/104; C10N 2260/14
USPC ..... 508/165, 179, 382
See application file for complete search history.

(56) References Cited

U.S. PATENT DOCUMENTS

| | | | | |
|---|---|---|---|---|
| 5,387,351 | A | 2/1995 | Kumar et al. | |
| 5,405,545 | A | 4/1995 | Horodysky et al. | |
| 5,674,820 | A | 10/1997 | Manka et al. | |
| 6,172,012 | B1 | 1/2001 | Kumar et al. | |
| 6,588,393 | B2 * | 7/2003 | Chamberlin et al. | 123/196 R |
| 2003/0148899 | A1 | 8/2003 | Kuribayashi et al. | |
| 2004/0235686 | A1 | 11/2004 | Boons et al. | |
| 2004/0266631 | A1 | 12/2004 | Burrington et al. | |
| 2006/0014651 | A1 * | 1/2006 | Esche et al. | 508/162 |
| 2006/0205615 | A1 | 9/2006 | Esche | |
| 2006/0217271 | A1 * | 9/2006 | Brown et al. | 508/165 |
| 2007/0111907 | A1 * | 5/2007 | Esche et al. | 508/364 |
| 2007/0111908 | A1 | 5/2007 | Lam et al. | |
| 2007/0132274 | A1 | 6/2007 | Lam et al. | |
| 2007/0149418 | A1 | 6/2007 | Esche et al. | |
| 2008/0221000 | A1 * | 9/2008 | Chase | C10M 133/02 508/262 |

FOREIGN PATENT DOCUMENTS

| | | | |
|---|---|---|---|
| JP | 2002302691 | A | 10/2002 |
| JP | 2004149762 | A | 5/2004 |
| WO | 2006/105022 | | 10/2006 |

OTHER PUBLICATIONS

The IP.com Journal 7, vol. 2, 9 pp. 57-58 (Sep. 2002), announcing that Yamaguchi, E.S., Friction and Wear Measurements Using a Modified MTM Tribometer, pp. 1-33 published on IP.com on Aug. 7, 2002 as No. IPCOM000009117D.

International Search Report issued in counterpart European Patent Application No. 09818308.

The Office Action issued in counterpart Japanese Patent Application No. 2011-529250.

* cited by examiner

*Primary Examiner* — James Goloboy

(74) *Attorney, Agent, or Firm* — M. Carmen & Associates PLLC

(57) ABSTRACT

A lubricating oil composition is disclosed which comprises (a) a major amount of an oil of lubricating viscosity; and (b) an oil-soluble titanium compound of Formula I:

(I)

wherein $R^1$, $R^2$, $R^3$ and $R^4$ are independently a $C_1$-$C_{20}$ alkoxy group, and further wherein the lubricating oil composition is free of any zinc dialkyldithiophosphate.

30 Claims, 3 Drawing Sheets

LUBRICATING OIL COMPOSITIONS

BACKGROUND OF THE INVENTION

1. Technical Field

The present invention generally relates to lubricating oil compositions.

2. Description of the Related Art

Automobile spark ignition and diesel engines have valve train systems, including valves, cams and rocker arms, which present special lubrication concerns. It is extremely important that the lubricant, i.e., the engine oil, protects these parts from wear. It is also important for the engine oils to suppress the production of deposits in the engines. Such deposits are produced from non-combustibles and incomplete combustion of hydrocarbon fuels (e.g., gasoline and diesel fuel oil) and by the deterioration of the engine oil employed.

Engine oils typically use a mineral oil or a synthetic oil as a base oil. However, simple base oils alone do not provide the necessary properties to provide the necessary wear protection, deposit control, etc., required to protect internal combustion engines. Thus, base oils are formulated with various additives, for imparting auxiliary functions, such as ashless dispersants, metallic detergents (i.e., metal-containing detergents), antiwear agents, antioxidants (i.e., oxidation inhibitors), viscosity index improvers and the like to give a formulated oil (i.e., a lubricating oil composition).

A number of such engine oil additives are known and employed in practice. For example, zinc dialkyldithiophosphates are usually contained in the commercially available internal composition engine oils, especially those used for automobiles, because of their favorable characteristics as an antiwear agent and performance as an oxidation inhibitor.

However, a problem associated with the use of zinc dialkyldithiophosphate is that their phosphorus and sulfur derivatives poison the catalyst components of the catalytic converters. This is a major concern as effective catalytic converters are needed to reduce pollution and to meet governmental regulation designed to reduce toxic gases such as, for example, hydrocarbons, carbon monoxide and nitrogen oxides, in internal combustion engine exhaust emissions. Such catalytic converters generally use a combination of catalytic metals, e.g., platinum and metal oxides, and are installed in the exhaust streams, e.g., the exhaust pipes of automobiles, to convert the toxic gases to nontoxic gases. As previously mentioned, these catalyst components are poisoned by the phosphorus and sulfur components, or the phosphorus and sulfur decomposition product of the zinc dialkyldithiophosphate; and accordingly, the use of engine oils containing phosphorus and sulfur additives may substantially reduce the life and effectiveness of catalytic converters.

There is also governmental and automotive industry pressure towards reducing the phosphorus and sulfur content. For example, current GF-4 motor oil specifications require a finished oil to contain less than 0.08 wt % and 0.7 wt % phosphorus and sulfur, respectively, and CJ-4 motor oil specifications, the most current generation heavy duty diesel engine oil, require an oil to contain less than 0.12 wt % and 0.4 wt % phosphorus and sulfur, respectively, and 1.0 wt % sulfated ash. It is widely believed that lowering these limits may have a serious impact on engine performance, engine wear, and oxidation of engine oils. This is because historically a major contributor to the phosphorus content in engine oils has been zinc dialkyldithiophosphates. Accordingly, it would be desirable to eliminate the amount of zinc dialkyldithiophosphate in lubricating oils, thus reducing catalyst deactivation and hence increasing the life and effectiveness of catalytic converters while also meeting future industry standard proposed phosphorus and sulfur contents in the engine oil. However, simply decreasing the amount of zinc dialkyldithiophosphate presents problems because this necessarily lowers the antiwear properties and oxidation inhibition properties of the lubricating oil. Therefore, it is necessary to find a way to reduce or eliminate phosphorus and sulfur content while still retaining the antiwear properties of the higher phosphorus and sulfur content engine oils.

U.S. Patent Application Publication No. 20060217271 ("the '271 application") discloses a lubricating oil composition containing (a) an oil of lubricating viscosity, (b) 1 to 1000 parts per million by weight of titanium in the form of an oil-soluble titanium-containing material, and (c) at least one additive selected from the group consisting of (i) anti-wear agents, (ii) dispersants, (iii) antioxidants, and (iv) detergents. All of the examples disclosed in the '271 application employ titanium isopropoxide in combination with a zinc dithiophosphate.

U.S. Patent Application Publication No. 20070149418 ("the '418 application") discloses a lubricating oil composition containing (a) an oil of lubricating viscosity, (b) a friction modifier selected from the group consisting essentially of an organomolybdenum friction modifier, a glycerol ester friction modifier, and mixtures thereof, and (c) an antiwear agent comprising an amount of at least one hydrocarbon soluble titanium compound effective to provide an increase in antiwear properties of the lubricant composition greater than an increase in antiwear properties of the lubricant composition devoid of the hydrocarbon soluble titanium compound, wherein the compound is essentially devoid of sulfur and phosphorus atoms. The '418 application further discloses that the hydrocarbon soluble titanium compound is a reaction product of a titanium alkoxide and an about $C_6$ to about $C_{25}$ carboxylic acid. All of the examples disclosed in the '418 application disclose a hydrocarbon soluble titanium compound in combination with a zinc dithiophosphate.

Therefore, as demand for further decrease of the phosphorus content and a limit on the sulfur content of lubricating oils is very high, this reduction cannot be satisfied by the present measures in practice and still meet the severe antiwear and oxidation-corrosion inhibiting properties required of today's engine oils. Accordingly, it would be desirable to develop lubricating oil compositions having relatively low levels or free of any phosphorus content while also having relatively low levels of sulfur and sulfated ash but which still provide the needed wear protection now provided by lubricating oils containing a zinc dialkyldithiophosphate. It would also be desirable to develop lubricating oil compositions which are free of any zinc dialkyldithiophosphate.

SUMMARY OF THE INVENTION

In accordance with one embodiment of the present invention, a lubricating oil composition is provided which comprises (a) a major amount of an oil of lubricating viscosity; and (b) an oil-soluble titanium compound of Formula I:

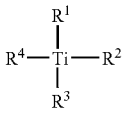

(I)

wherein $R^1$, $R^2$, $R^3$ and $R^4$ are independently a $C_1$-$C_{20}$ alkoxy group, and further wherein the lubricating oil composition is free of any zinc dialkyldithiophosphate.

In accordance with a second embodiment of the present invention, a method of reducing wear of metal parts in an internal combustion engine is provided comprising operating the engine with a lubricating oil composition comprising (i) a major amount of an oil of lubricating viscosity and (ii) an oil-soluble titanium compound of Formula I:

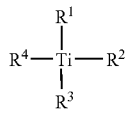

(I)

$R^1$, $R^2$, $R^3$ and $R^4$ are independently a $C_1$-$C_{20}$ alkoxy group, and further wherein the lubricating oil composition is free of any zinc dialkyldithiophosphate.

In accordance with a third embodiment of the present invention, there is provided an internal combustion engine lubricated with a lubricating oil composition comprising (a) a major amount of an oil of lubricating viscosity and (b) an oil-soluble titanium compound of Formula I:

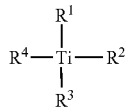

(I)

$R^1$, $R^2$, $R^3$ and $R^4$ are independently a $C_1$-$C_{20}$ alkoxy group, and further wherein the lubricating oil composition is free of any zinc dialkyldithiophosphate.

By employing the oil-soluble titanium compound disclosed herein in a lubricating oil composition of the present invention in the absence of any zinc dialkyl dithiophosphate compound, it has unexpectedly been discovered that the lubricating oil composition advantageously possesses improved or relatively comparable wear reducing properties as compared to a corresponding lubricating oil composition in which the oil-soluble titanium compound disclosed herein in the lubricating oil composition is replaced with a zinc dialkyl dithiophosphate compound. In addition, the wear reducing properties can be achieved with the lubricating oil compositions of the present invention while also employing relatively low levels or free of any phosphorus content as well as relatively low levels of sulfur and sulfated ash.

DETAILED DESCRIPTION OF THE PREFERRED EMBODIMENTS

Figure 1:
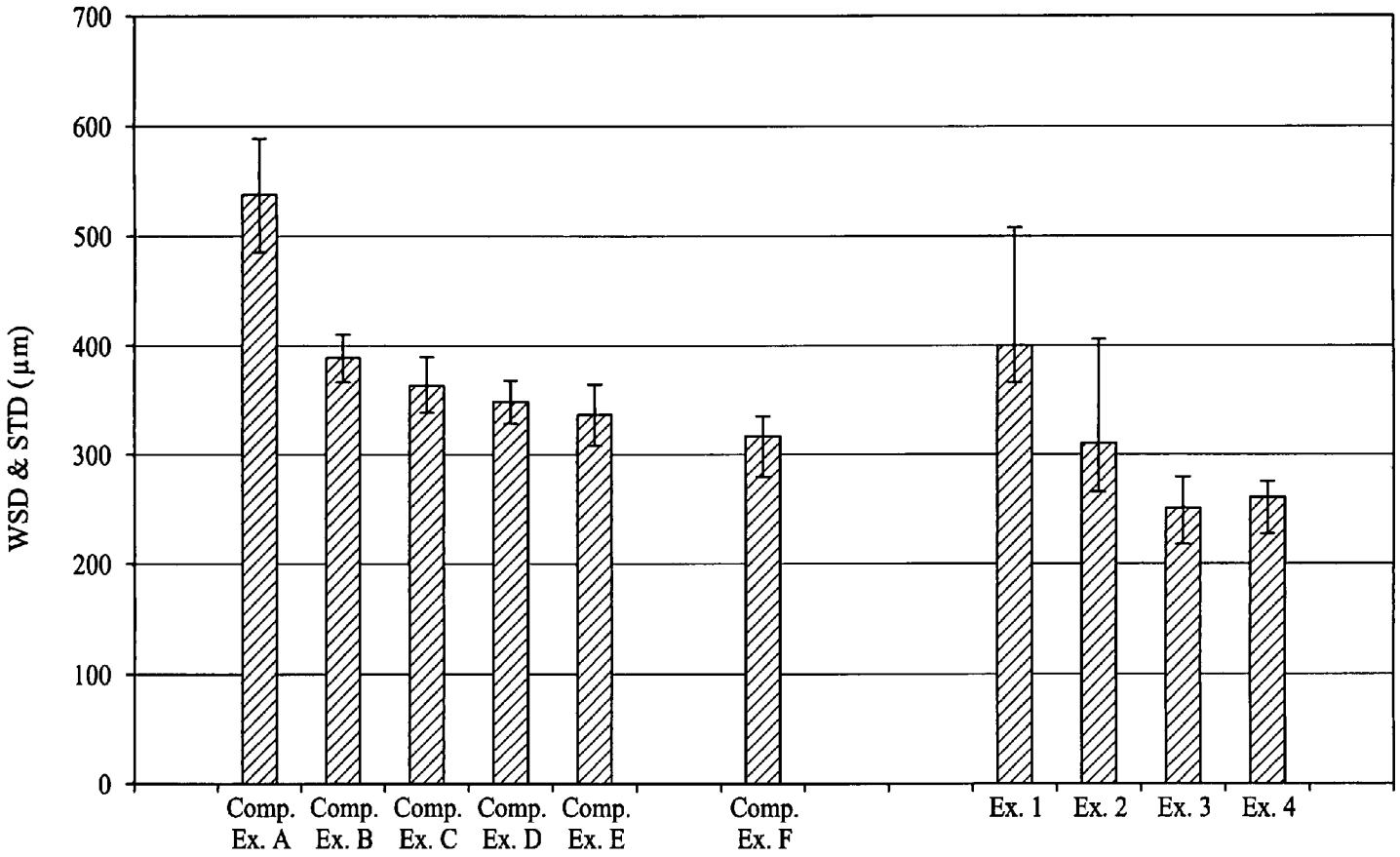
FIG. 1 is a bar graph comparing the wear performance of the lubricating oil composition of Examples 1-4 versus the lubricating oil compositions of Comparative Examples A-F.

The present invention is directed to a lubricating oil composition containing at least (a) a major amount of an oil of lubricating viscosity; and (b) an oil-soluble titanium compound of Formula I set forth hereinbelow, wherein the lubricating oil composition is free of any zinc dialkyldithiophosphate. In one embodiment, the lubricating oil composition of the present invention is substantially free of any phosphorus, e.g., a phosphorus content not exceeding 0.08 wt. %, more preferably not exceeding 0.05 wt. % and most preferably 0 wt. %. In another embodiment, the lubricating oil composition of the present invention contains relatively low levels of sulfur, i.e., not exceeding 0.7 wt. %. The lubricating oil composition of the present invention can also have a sulfated ash content of no more than about 1 wt. % as determined by ASTM D874 and preferably no more than about 0.91 wt. % as determined by ASTM D874. The amount of phosphorus and sulfur in the lubricating oil composition of the present invention is measured according to ASTM D4951.

The oil of lubricating viscosity for use in the lubricating oil compositions of the present invention, also referred to as a base oil, is typically present therein in a major amount, e.g., an amount of greater than 50 wt. %, preferably greater than about 70 wt. %, more preferably from about 80 to about 99.5 wt. % and most preferably from about 85 to about 98 wt. %, based on the total weight of the composition. The expression "base oil" as used herein shall be understood to mean a base stock or blend of base stocks which is a lubricant component that is produced by a single manufacturer to the same specifications (independent of feed source or manufacturer's location); that meets the same manufacturer's specification; and that is identified by a unique formula, product identification number, or both.

The base oil for use herein can be any presently known or later-discovered oil of lubricating viscosity used in formulating lubricating oil compositions for any and all such applications, e.g., engine oils, marine cylinder oils, functional fluids such as hydraulic oils, gear oils, transmission fluids, etc. The selection of the particular base oil depends on the contemplated application of the lubricant and the presence of other additives. For example, the oil of lubricating viscosity useful in the practice of the invention may range in viscosity from light distillate mineral oils to heavy lubricating oils such as gasoline engine oils, mineral lubricating oils and heavy duty diesel oils. Additionally, the base oils for use herein can optionally contain viscosity index improvers, e.g., polymeric alkylmethacrylates; olefinic copolymers, e.g., an ethylene-propylene copolymer or a styrene-butadiene copolymer; and the like and mixtures thereof. The lubricating oil compositions of this invention can be prepared by admixing, by conventional techniques, an appropriate amount of the oil-soluble titanium compound disclosed herein with an oil of lubricating viscosity and conventional lubricating oil additives. Alternatively, the lubricating oil compositions of this invention can be prepared by admixing, by conventional techniques, an appropriate amount of the oil-soluble titanium compound disclosed herein in an additive concentrate with an oil of lubricating viscosity and conventional lubricating oil additives As one skilled in the art would readily appreciate, the viscosity of the base oil is dependent upon the application. Accordingly, the viscosity of a base oil for use herein will ordinarily range from about 2 to about 2000 centistokes (cSt) at 100° Centigrade (C.). Generally, individually the base oils used as engine oils will have a kinematic viscosity range at 100° C. of about 2 cSt to about 30 cSt, preferably about 3 cSt to about 16 cSt, and most preferably about 4 cSt to about 12 cSt and will be selected or blended depending on the desired end use and the additives in the finished oil to give the desired grade of engine oil, e.g., a lubricating oil composition having an SAE Viscosity Grade of 0W, 0W-20, 0W-30, 0W-40, 0W-50, 0W-60, 5W, 5W-20, 5W-30, 5W-40, 5W-50, 5W-60, 10W, 10W-20, 10W-30, 10W-40, 10W-50, 15W, 15W-20, 15W-30 or 15W-40. Oils used as gear oils can have viscosities ranging from about 2 cSt to about 2000 cSt at 100° C.

Base stocks may be manufactured using a variety of different processes including, but not limited to, distillation, solvent refining, hydrogen processing, oligomerization, esterification, and rerefining. Rerefined stock shall be substantially free from materials introduced through manufacturing, contamination, or previous use. The base oil of the lubricating oil compositions of this invention may be any natural or synthetic lubricating base oil. Suitable hydrocarbon synthetic oils include, but are not limited to, oils prepared from the polymerization of ethylene or from the polymerization of 1-olefins to provide polymers such as polyalphaolefin or PAO oils, or from hydrocarbon synthesis procedures using carbon monoxide and hydrogen gases such as in a Fischer-Tropsch process. For example, a suitable base oil is one that comprises little, if any, heavy fraction; e.g., little, if any, lube oil fraction of viscosity 20 cSt or higher at 100° C.

The base oil may be derived from natural lubricating oils, synthetic lubricating oils or mixtures thereof. Suitable base oil includes base stocks obtained by isomerization of synthetic wax and slack wax, as well as hydrocracked base stocks produced by hydrocracking (rather than solvent extracting) the aromatic and polar components of the crude. Suitable base oils include those in all API categories I, II, III, IV and V as defined in API Publication 1509, 14th Edition, Addendum I, December 1998. Group IV base oils are polyalphaolefins (PAO). Group V base oils include all other base oils not included in Group I, II, III, or IV. Although Group II, III and IV base oils are preferred for use in this invention, these preferred base oils may be prepared by combining one or more of Group I, II, III, IV and V base stocks or base oils.

Useful natural oils include mineral lubricating oils such as, for example, liquid petroleum oils, solvent-treated or acid-treated mineral lubricating oils of the paraffinic, naphthenic or mixed paraffinic-naphthenic types, oils derived from coal or shale, animal oils, vegetable oils (e.g., rapeseed oils, castor oils and lard oil), and the like.

Useful synthetic lubricating oils include, but are not limited to, hydrocarbon oils and halo-substituted hydrocarbon oils such as polymerized and interpolymerized olefins, e.g., polybutylenes, polypropylenes, propylene-isobutylene copolymers, chlorinated polybutylenes, poly(1-hexenes), poly(1-octenes), poly(1-decenes), and the like and mixtures thereof; alkylbenzenes such as dodecylbenzenes, tetradecylbenzenes, dinonylbenzenes, di(2-ethylhexyl)-benzenes, and the like; polyphenyls such as biphenyls, terphenyls, alkylated polyphenyls, and the like; alkylated diphenyl ethers and alkylated diphenyl sulfides and the derivative, analogs and homologs thereof and the like.

Other useful synthetic lubricating oils include, but are not limited to, oils made by polymerizing olefins of less than 5 carbon atoms such as ethylene, propylene, butylenes, isobutene, pentene, and mixtures thereof. Methods of preparing such polymer oils are well known to those skilled in the art.

Additional useful synthetic hydrocarbon oils include liquid polymers of alpha olefins having the proper viscosity. Especially useful synthetic hydrocarbon oils are the hydrogenated liquid oligomers of $C_6$ to $C_{12}$ alpha olefins such as, for example, 1-decene trimer.

Another class of useful synthetic lubricating oils include, but are not limited to, alkylene oxide polymers, i.e., homopolymers, interpolymers, and derivatives thereof where the terminal hydroxyl groups have been modified by, for example, esterification or etherification. These oils are exemplified by the oils prepared through polymerization of ethylene oxide or propylene oxide, the alkyl and phenyl ethers of these polyoxyalkylene polymers (e.g., methyl poly propylene glycol ether having an average molecular weight of 1,000, diphenyl ether of polyethylene glycol having a molecular weight of 500 to 1000, diethyl ether of polypropylene glycol having a molecular weight of 1,000 to 1,500, etc.) or mono- and polycarboxylic esters thereof such as, for example, the acetic esters, mixed $C_3$-$C_8$ fatty acid esters, or the $C_{13}$ oxo acid diester of tetraethylene glycol.

Yet another class of useful synthetic lubricating oils include, but are not limited to, the esters of dicarboxylic acids e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acids, alkyl malonic acids, alkenyl malonic acids, etc., with a variety of alcohols, e.g., butyl alcohol, hexyl alcohol, dodecyl alcohol, 2-ethylhexyl alcohol, ethylene glycol, diethylene glycol monoether, propylene glycol, etc. Specific examples of these esters include dibutyl adipate, di(2-ethylhexyl)sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include, but are not limited to, those made from carboxylic acids having from about 5 to about 12 carbon atoms with alcohols, e.g., methanol, ethanol, etc., polyols and polyol ethers such as neopentyl glycol, trimethylol propane, pentaerythritol, dipentaerythritol, tripentaerythritol, and the like.

Silicon-based oils such as, for example, polyalkyl-, polyaryl-, polyalkoxy- or polyaryloxy-siloxane oils and silicate oils, comprise another useful class of synthetic lubricating oils. Specific examples of these include, but are not limited to, tetraethyl silicate, tetra-isopropyl silicate, tetra-(2-ethylhexyl) silicate, tetra-(4-methyl-hexyl)silicate, tetra-(p-tert-butylphenyl)silicate, hexyl-(4-methyl-2-pentoxy)disiloxane, poly(methyl)siloxanes, poly(methylphenyl)siloxanes, and the like.

The lubricating oil may be derived from unrefined, refined and rerefined oils, either natural, synthetic or mixtures of two or more of any of these of the type disclosed hereinabove. Unrefined oils are those obtained directly from a natural or synthetic source (e.g., coal, shale, or tar sands bitumen) without further purification or treatment. Examples of unrefined oils include, but are not limited to, a shale oil obtained directly from retorting operations, a petroleum oil obtained directly from distillation or an ester oil obtained directly from an esterification process, each of which is then used without further treatment. Refined oils are similar to the unrefined oils except they have been further treated in one or more purification steps to improve one or more properties. These purification techniques are known to those of skill in the art and include, for example, solvent extractions, secondary distillation, acid or base extraction, filtration, percolation, hydrotreating, dewaxing, etc. Rerefined oils are obtained by treating used oils in processes similar to those used to obtain refined oils. Such rerefined oils are also known as reclaimed or reprocessed oils and often are additionally processed by techniques directed to removal of spent additives and oil breakdown products.

Lubricating oil base stocks derived from the hydroisomerization of wax may also be used, either alone or in combination with the aforesaid natural and/or synthetic base stocks. Such wax isomerate oil is produced by the hydroisomerization of natural or synthetic waxes or mixtures thereof over a hydroisomerization catalyst.

Natural waxes are typically the slack waxes recovered by the solvent dewaxing of mineral oils; synthetic waxes are typically the wax produced by the Fischer-Tropsch process.

In general, an oil-soluble titanium compound for use in the lubricating oil composition of the present invention is represented by the structure of Formula I:

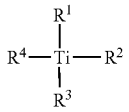

(I)

wherein $R^1$, $R^2$, $R^3$ and $R^4$ are independently a $C_1$ to $C_{20}$ alkoxy group and preferably independently a $C_3$ to $C_8$ alkoxy group. In one embodiment, at least two of $R^1$, $R^2$, $R^3$ and $R^4$ are the same $C_1$ to $C_{20}$ alkoxy group or $C_3$ to $C_8$ alkoxy group. In another embodiment, at least three of $R^1$, $R^2$, $R^3$ and $R^4$ are the same $C_1$ to $C_{20}$ alkoxy group or $C_3$ to $C_8$ alkoxy group. In a preferred embodiment, each of $R^1$, $R^2$, $R^3$ and $R^4$ are the same $C_1$ to $C_{20}$ alkoxy group or $C_3$ to $C_8$ alkoxy group.

Representative examples of alkoxy groups for use herein include, by way of example, an alkyl group as defined herein attached via oxygen linkage to the rest of the molecule, i.e., of the general Formula —$OR^5$, wherein $R^5$ is an alkyl, cycloalkyl, cycloalkylalkyl, cycloalkenyl, aryl or an arylalkyl as defined herein, e.g., —$OCH_3$, —$OC_2H_5$, or —$OC_6H_5$, and the like.

Representative examples of alkyl groups for use herein include, by way of example, a straight or branched alkyl chain radical containing carbon and hydrogen atoms of from 1 to about 20 carbon atoms and preferably from 1 to about 8 carbon atoms with or without unsaturation, to the rest of the molecule, e.g., methyl, ethyl, n-propyl, isopropyl, n-butyl, n-pentyl, etc., and the like.

Representative examples of cycloalkyl groups for use herein include, by way of example, a substituted or unsubstituted non-aromatic mono or multicyclic ring system of about 3 to about 20 carbon atoms such as, for example, cyclopropyl, cyclobutyl, cyclopentyl, cyclohexyl, bridged cyclic groups or sprirobicyclic groups, e.g., spiro-(4,4)-non-2-yl and the like, optionally containing one or more heteroatoms, e.g., O and N, and the like.

Representative examples of cycloalkylalkyl groups for use herein include, by way of example, a substituted or unsubstituted cyclic ring-containing radical containing from about 3 to about 20 carbon atoms directly attached to the alkyl group which are then attached to the main structure of the monomer at any carbon from the alkyl group that results in the creation of a stable structure such as, for example, cyclopropylmethyl, cyclobutylethyl, cyclopentylethyl and the like, wherein the cyclic ring can optionally contain one or more heteroatoms, e.g., O and N, and the like.

Representative examples of cycloalkenyl groups for use herein include, by way of example, a substituted or unsubstituted cyclic ring-containing radical containing from about 3 to about 20 carbon atoms with at least one carbon-carbon double bond such as, for example, cyclopropenyl, cyclobutenyl, cyclopentenyl and the like, wherein the cyclic ring can optionally contain one or more heteroatoms, e.g., O and N, and the like.

Representative examples of aryl groups for use herein include, by way of example, a substituted or unsubstituted monoaromatic or polyaromatic radical containing from about 5 to about 20 carbon atoms such as, for example, phenyl, naphthyl, tetrahydronapthyl, indenyl, biphenyl and the like, optionally containing one or more heteroatoms, e.g., O and N, and the like.

Representative examples of arylalkyl groups for use herein include, by way of example, a substituted or unsubstituted aryl group as defined herein directly bonded to an alkyl group as defined herein, e.g., —$CH_2C_6H_5$, —$C_2H_5C_6H_5$ and the like, wherein the aryl group can optionally contain one or more heteroatoms, e.g., O and N, and the like.

In one embodiment, representative examples of a suitable oil-soluble titanium compound represented by the structure of Formula I includes titanium (IV) alkoxides such as titanium methoxide, titanium ethoxide, titanium propoxide, titanium isopropoxide, titanium butoxide, titanium 2-ethylhexoxide, titanium isobutoxide, titanium 4-methyl-2-pentoxide, titanium hexoxide, titanium pentoxide, titanium isopentoxide, titanium triethanolaminato-isopropoxide and the like and mixtures thereof. The oil-soluble titanium compounds disclosed herein are commercially available or can be readily prepared by appropriate synthesis techniques which will be apparent to the person skilled in the art. In addition, they may exist at room temperature as a solid or a liquid, depending on the particular compound. Alternatively, they may also be provided in a solution form in an appropriate inert solvent.

The oil-soluble titanium compounds of Formula I advantageously provide excellent antiwear protection when incorporated into a lubricating oil composition which is free of any zinc dialkyldithiophosphate. Generally, the amount of the oil-soluble titanium compound present in the lubricating oil composition will vary from about 0.2 wt. % to about 4 wt. %, and preferably from about 0.6 wt. % to about 3 wt. %, based on the total weight of the lubricating oil composition.

The lubricating oil compositions of the present invention may also contain other conventional additives for imparting auxiliary functions to give a finished lubricating oil composition in which these additives are dispersed or dissolved. For example, the lubricating oil compositions can be blended with antioxidants, anti-wear agents, detergents such as metal detergents, rust inhibitors, dehazing agents, demulsifying agents, metal deactivating agents, friction modifiers, pour point depressants, antifoaming agents, co-solvents, package compatibilisers, corrosion-inhibitors, ashless dispersants, dyes, extreme pressure agents and the like and mixtures thereof. A variety of the additives are known and commercially available. These additives, or their analogous compounds, can be employed for the preparation of the lubricating oil compositions of the invention by the usual blending procedures.

Examples of antioxidants include, but are not limited to, aminic types, e.g., diphenylamine, phenyl-alpha-napthylamine, N,N-di(alkylphenyl)amines; and alkylated phenylene-diamines; phenolics such as, for example, BHT, sterically hindered alkyl phenols such as 2,6-di-tert-butylphenol, 2,6-di-tert-butyl-p-cresol and 2,6-di-tert-butyl-4-(2-octyl-3-propanoic)phenol; and mixtures thereof.

Examples of ashless dispersants include, but are not limited to, polyalkylene succinic anhydrides; non-nitrogen containing derivatives of a polyalkylene succinic anhydride; a basic nitrogen compound selected from the group consisting of succinimides, carboxylic acid amides, hydrocarbyl monoamines, hydrocarbyl polyamines, Mannich bases, phosphonoamides, and phosphoramides; triazoles, e.g., alkyltriazoles and benzotriazoles; copolymers which contain a carboxylate ester with one or more additional polar function, including amine, amide, imine, imide, hydroxyl, carboxyl, and the like, e.g., products prepared by copolymerization of long chain alkyl acrylates or methacrylates with monomers of the above function; and the like and mixtures thereof. The derivatives of these dispersants, e.g., borated dispersants such as borated succinimides, may also be used.

Examples of rust inhibitors include, but are not limited to, nonionic polyoxyalkylene agents, e.g., polyoxyethylene lauryl ether, polyoxyethylene higher alcohol ether, polyoxyethylene nonylphenyl ether, polyoxyethylene octylphenyl ether, polyoxyethylene octyl stearyl ether, polyoxyethylene oleyl ether, polyoxyethylene sorbitol monostearate, polyoxyethylene sorbitol monooleate, and polyethylene glycol monooleate; stearic acid and other fatty acids; dicarboxylic acids; metal soaps; fatty acid amine salts; metal salts of heavy sulfonic acid; partial carboxylic acid ester of polyhydric alcohol; phosphoric esters; (short-chain) alkenyl succinic acids; partial esters thereof and nitrogen-containing derivatives thereof; synthetic alkarylsulfonates, e.g., metal dinonylnaphthalene sulfonates; and the like and mixtures thereof.

Examples of friction modifiers include, but are not limited to, alkoxylated fatty amines; borated fatty epoxides; fatty phosphites, fatty epoxides, fatty amines, borated alkoxylated fatty amines, metal salts of fatty acids, fatty acid amides, glycerol esters, borated glycerol esters; and fatty imidazolines as disclosed in U.S. Pat. No. 6,372,696, the contents of which are incorporated by reference herein; friction modifiers obtained from a reaction product of a $C_4$ to $C_{75}$, preferably a $C_6$ to $C_{24}$, and most preferably a $C_6$ to $C_{20}$, fatty acid ester and a nitrogen-containing compound selected from the group consisting of ammonia, and an alkanolamine and the like and mixtures thereof.

Examples of antifoaming agents include, but are not limited to, polymers of alkyl methacrylate; polymers of dimethylsilicone and the like and mixtures thereof.

Each of the foregoing additives, when used, is used at a functionally effective amount to impart the desired properties to the lubricant. Thus, for example, if an additive is a friction modifier, a functionally effective amount of this friction modifier would be an amount sufficient to impart the desired friction modifying characteristics to the lubricant. Generally, the concentration of each of these additives, when used, ranges from about 0.001% to about 20% by weight, and in one embodiment about 0.01% to about 10% by weight based on the total weight of the lubricating oil composition.

The final application of the lubricating oil compositions of this invention may be, for example, in marine cylinder lubricants in crosshead diesel engines, crankcase lubricants in automobiles and railroads and the like, lubricants for heavy machinery such as steel mills and the like, or as greases for bearings and the like. In one embodiment, the lubricating oil compositions of this invention are used to lubricate an internal combustion engine such as a spark ignition engine, or a compression ignition diesel engine, e.g., a heavy duty diesel engine or a compression ignition diesel engine equipped with at least one of an exhaust gas recirculation (EGR) system; a catalytic converter; and a particulate trap.

Whether the lubricating oil composition is fluid or solid will ordinarily depend on whether a thickening agent is present. Typical thickening agents include polyurea acetates, lithium stearate and the like.

In another embodiment of the invention, the oil-soluble titanium compound disclosed herein may be provided as an additive package or concentrate in which the titanium compound is incorporated into a substantially inert, normally liquid organic diluent such as, for example, mineral oil, naphtha, benzene, toluene or xylene to form an additive concentrate. These concentrates usually contain from about 20% to about 80% by weight of such diluent. Typically a neutral oil having a viscosity of about 4 to about 8.5 cSt at 100° C. and preferably about 4 to about 6 cSt at 100° C. will be used as the diluent, though synthetic oils, as well as other organic liquids which are compatible with the additives and finished lubricating oil can also be used. The additive package will also typically contain one or more of the various other additives, referred to above, in the desired amounts and ratios to facilitate direct combination with the requisite amount of base oil.

The following non-limiting examples are illustrative of the present invention.

Comparative Example A

A baseline lubricating oil formulation typical for a generic low emission diesel lubricant (LEDL) without zinc dialkyldithiophosphate was formed containing approximately 75 wt. % of a 2:1 mixture of Chevron 100N and Chevron 220N base oils, a succinimide dispersant mixture of approximately 4.75 wt. % of a bis-succinimide prepared from a 2300 average molecular weight polyisobutenyl succinic anhydride with a heavy polyamine, 2.5 wt. % of a borated bis-succinimide prepared from a 1300 average molecular weight polyisobutylene succinic anhydride with a heavy polyamine, approximately 4.5 wt. % of a 140 TBN salicylate detergent prepared mixture of $C_{18-30}$ alpha olefins and $C_{10}$ to $C_{15}$ branched olefins (e.g., prepared as disclosed in U.S. Patent Application Publication No. 2004/0235686, the contents of which are incorporated herein by reference), approximately 0.6 wt. % of a 16 TBN calcium synthetic alkylaryl sulfonate prepared from a mixture of $C_{20}$ to $C_{40}$ alpha olefins and $C_{10}$ to $C_{15}$ branched olefins, approximately 1 wt. % of an equal part mixture of antioxidants comprising a mixture of an octylated/butylated diphenylamine and a hindered phenol antioxidant, 10.85 wt. % an ethylene-propylene copolymer and 5 ppm foam inhibitor.

The resulting baseline oil formulation had a sulfated ash content of 0.85 wt. % as determined by ASTM D874, a phosphorus content of 0 wt. % and a sulfur content of 0.075 wt. %.

Example 1

A baseline lubricating oil formulation was formed containing the same additives, base oil and treat rate, as in Comparative Example A. Titanium (IV) isopropoxide was formulated into this baseline lubricating oil formulation at 0.30 wt. %.

The resulting lubricating oil composition had a sulfated ash content of 0.94 wt. % as determined by ASTM D874, a phosphorus content of 0 wt. % and a sulfur content of 0.075 wt. %.

Example 2

A baseline lubricating oil formulation was formed containing the same additives, base oil and treat rate, as in Comparative Example A. Titanium (IV) isopropoxide was formulated into this baseline lubricating oil formulation at 0.5 wt. %.

The resulting lubricating oil composition had a sulfated ash content of 0.99 wt. % as determined by ASTM D874, a phosphorus content of 0 wt. % and a sulfur content of 0.074 wt. %.

Example 3

A baseline lubricating oil formulation was formed containing the same additives, base oil and treat rate, as in Comparative Example A. Titanium (IV) isopropoxide was formulated into this baseline lubricating oil formulation at 1 wt. %.

The resulting lubricating oil composition had a sulfated ash content of 1.14 wt. % as determined by ASTM D874, a phosphorus content of 0 wt. % and a sulfur content of 0.075 wt. %.

Example 4

A baseline lubricating oil formulation was formed containing the same additives, base oil and treat rate, as in Comparative Example A. Titanium (IV) isopropoxide was formulated into this baseline lubricating oil formulation at 2 wt. %.

The resulting lubricating oil composition had a sulfated ash content of 1.44 wt. % as determined by ASTM D874, a phosphorus content of 0 wt. % and a sulfur content of 0.072 wt. %.

Comparative Example B

A baseline lubricating oil formulation was formed containing the same additives, base oil and treat rate, as in Comparative Example A. A secondary ZnDTP derived from derived from sec-butanol and methylisobutylcarbinol was formulated into this baseline lubricating oil formulation at 0.7 wt. %.

The resulting lubricating oil composition had a sulfated ash content of 0.96 wt. % as determined by ASTM D874, a phosphorus content of 0.05 wt. % and a sulfur content of 0.18 wt. %.

Comparative Example C

A baseline lubricating oil formulation was formed containing the same additives, base oil and treat rate, as in Comparative Example A. A secondary ZnDTP derived from derived from sec-butanol and methylisobutylcarbinol was formulated into this baseline lubricating oil formulation at 1.05 wt. %.

The resulting lubricating oil composition had a sulfated ash content of 1.05 wt. % as determined by ASTM D874, a phosphorus content of 0.076 wt. % and a sulfur content of 0.236 wt. %.

Comparative Example D

A baseline lubricating oil formulation was formed containing the same additives, base oil and treat rate, as in Comparative Example A. A secondary ZnDTP derived from derived from sec-butanol and methylisobutylcarbinol was formulated into this baseline lubricating oil formulation at 1.4 wt. %.

The resulting lubricating oil composition had a sulfated ash content of 1.11 wt. % as determined by ASTM D874, a phosphorus content of 0.102 wt. % and a sulfur content of 0.288 wt. %.

Comparative Example E

A baseline lubricating oil formulation was formed containing the same additives, base oil and treat rate, as in Comparative Example A. A secondary ZnDTP derived from derived from sec-butanol and methylisobutylcarbinol was formulated into this baseline lubricating oil formulation at 1.75 wt. %.

The resulting lubricating oil composition had a sulfated ash content of 1.13 wt. % as determined by ASTM D874, a phosphorus content of 0.13 wt. % and a sulfur content of 0.34 wt. %.

Comparative Example F

A lubricating oil composition was formed containing 2.35 wt. % succinimide dispersant, 6 wt. % borated succinimide dispersant, 2.84 wt. % 260 TBN sulfurized calcium phenate detergent, 1.02 wt. % 17 TBN calcium sulfonate detergent, 0.22 wt. % 410 TBN calcium sulfonate detergent, 0.3 wt. % diphenyl amine antioxidant, 0.6 wt. % hindered phenol antioxidant, 0.4 wt. % terephthalic acid salt of a bis-succinimide (derived from 1300 MW PIBSA and heavy polyarnine) dispersant, 0.5 wt. % molybdenum succinimide complex dispersant/wear inhibitor, 10 ppm foam inhibitor, 5.75 wt. % viscosity index improver, 0.3 wt. % pour point depressant, 0.75 wt. % viscosity index improver, and 1.89 wt. % zinc dihydrocarbyl dithiophophate in 76.17 wt. % base oil consisting of 24.5% Group II base oil having a kinematic viscosity (kv) at 100° C. of 4.7 to 4.9 cSt and 75.5% Group II base oil having a kv at 100° C. of 7.8 to 7.9 cSt.

The resulting lubricating oil composition had a sulfated ash content of 1.40 wt. % as determined by ASTM D874, a phosphorus content of 0.15 wt. % and a sulfur content of 0.45 wt. %.

Comparative Example G

A baseline lubricating oil formulation was formed containing approximately 75 wt. % of a Group II base oil, a succinimide dispersant mixture of approximately 2 wt. % of a bis-succinimide prepared from a 2300 average molecular weight polyisobutylene, succinic anhydride and a heavy polyamine, 4 wt. % of a borated bis-succinimide prepared from a 1300 average molecular weight polyisobutylene, succinic anhydride, and a heavy polyamine, 3 wt. % of a polysuccinimide dispersant, approximately 0.4 wt. % of a 395 TBN magnesium sulfonate detergent, approximately 0.5 wt. % of a 160 TBN borated sulfonate detergent, approximately 1.0 wt. % of a 250 TBN sulfurized calcium phenate detergent, approximately 0.3 wt. % of a 16 TBN calcium sulfonate detergent, approximately 0.2 wt. % of a molybdenum oxysulfide complex of a mono-succinimide prepared from a 1000 average molecular weight polyisobutylene, succinic anhydride, and a mixture of heavy polyamine and diethylenetriamine, approximately 0.3 wt. % of an octylated/butylated diphenylamine antioxidant, approximately 0.5 wt. % a hindered phenol antioxidant, 5.40 wt. % ethylene-propylene and 5 ppm foam inhibitor.

The resulting baseline lubricating oil formulation had a sulfated ash content of 0.68 wt. % as determined by ASTM D874, a phosphorus content of 0 wt. % and a sulfur content of 0.09 wt. %.

Example 5

A baseline lubricating oil formulation was formed containing the same additives, base oil and treat rate, as in Comparative Example G. Titanium (IV) isopropoxide was formulated into this baseline lubricating oil formulation at 1 wt. %.

The resulting lubricating oil composition had a sulfated ash content of 0.92 wt. % as determined by ASTM D874, a phosphorus content of 0 wt. % and a sulfur content of 0.088 wt. %.

Comparative Example H

A baseline lubricating oil formulation was formed containing the same additives, base oil and treat rate, as in Comparative Example G. A secondary ZnDTP derived from derived from sec-butanol and methylisobutylcarbinol was formulated into this baseline lubricating oil formulation at 1.66 wt. %.

The resulting lubricating oil composition had a sulfated ash content of 1.04 wt. % as determined by ASTM D874, a phosphorus content of 0.13 wt. % and a sulfur content of 0.34 wt. %.

Comparative Example I

A baseline lubricating oil formulation was formed containing the same additives, base oil and treat rate, as in Comparative Example G. A secondary ZnDTP derived from derived from sec-butanol and methylisobutylcarbinol was formulated into this baseline lubricating oil formulation at 2.28 wt. %.

The resulting lubricating oil composition had a sulfated ash content of 1.32 wt. % as determined by ASTM D874, a phosphorus content of 0.16 wt. % and a sulfur content of 0.42 wt. %.

Performance Testing

The lubricating oil compositions of Examples 1-5 and the lubricating oil compositions of Comparative Examples A-F were evaluated using a PCS Instruments Ltd., London UK, Mini-Traction Machine (MTM) bench test. The PCS MTM instrument was modified so that a ¼-in. diameter Falex 52100 steel test ball (with special holder) was substituted for the pin holder that came with the instrument [See, e.g., Yamaguchi, E. S., "Friction and Wear Measurements Using a Modified MTM Tribometer," IP.com Journal 7, Vol. 2, 9, pp 57-58 (August 2002), No. IPCOM000009117D]. The instrument was used in the pin-on-disk mode and run under sliding conditions. It is achieved by fixing the ball rigidly in the special holder, such that the ball has only one degree of freedom, to slide on the disk. The conditions are shown in Table 1.

TABLE 1

| Test Conditions for MTM | | |
|---|---|---|
| Load | | 14 N |
| Initial Contact Pressure | | 1.53 GPa |
| Temperature | | 116° C. |
| Tribocouple | | 52100/52100 |
| Speed | mm/s | min |
| | 3800 | 10 |
| | 2000 | 10 |
| | 1000 | 10 |
| | 100 | 10 |
| | 20 | 10 |
| | 10 | 10 |
| | 5 | 10 |
| Length of Time | | 70 min |
| Diesel Engine Soot | | 9% |

Engine soot obtained from the overhead recovery system of an engine testing facility was used for this test. The soot was made into a slurry with pentane, filtered through a sintered glass funnel, dried in a vacuum oven under an nitrogen atmosphere and ground to 50 mesh (300 μm) maximum before use. The objective of this action was to make reproducible particles that would give rise to abrasive wear as seen in modern EGR engines.

To prepare the test specimens, the anti-corrosion coating of the PCS Instruments 52100 smooth (0.02 micron Ra), steel discs was removed using heptane, hexane, and isooctane. Then, the discs were wiped clean with a soft tissue and submersed in a beaker of the cleaning solvent until the film on the disc track had been removed, and the track of the disc appeared shiny. The discs and test balls were placed in individual containers and submerged in Chevron 450 thinner. Lastly, the test specimens were ultrasonically cleaned by placing them in a sonicator for 20 minutes.

FIG. 1 shows a comparison of the wear scar diameter (WSD) and standard deviation (STD) measured as a function of titanium or zinc concentration for the lubricating oil compositions of Examples 1-4 versus the lubricating oil compositions of Comparative Examples A-F. The lower values in the figure indicate less wear. As the data show, the lubricating oil compositions of Examples 1-4 containing a titanium (IV) isopropoxide and formed as Zn- and P-free lubricating oil compositions provided comparable and, in some instances, significantly better wear performance than the lubricating oil compositions of Comparative Examples A-F. It was particularly surprising that such low wear can be achieved by the lubricating oil compositions of Examples 1-4 containing a titanium (IV) isopropoxide as compared to the lubricating oil composition of Comparative Example F since the lubricating oil composition of Comparative Example F has a relatively high amount of zinc dialkyldithiophosphate.

Figure 2:
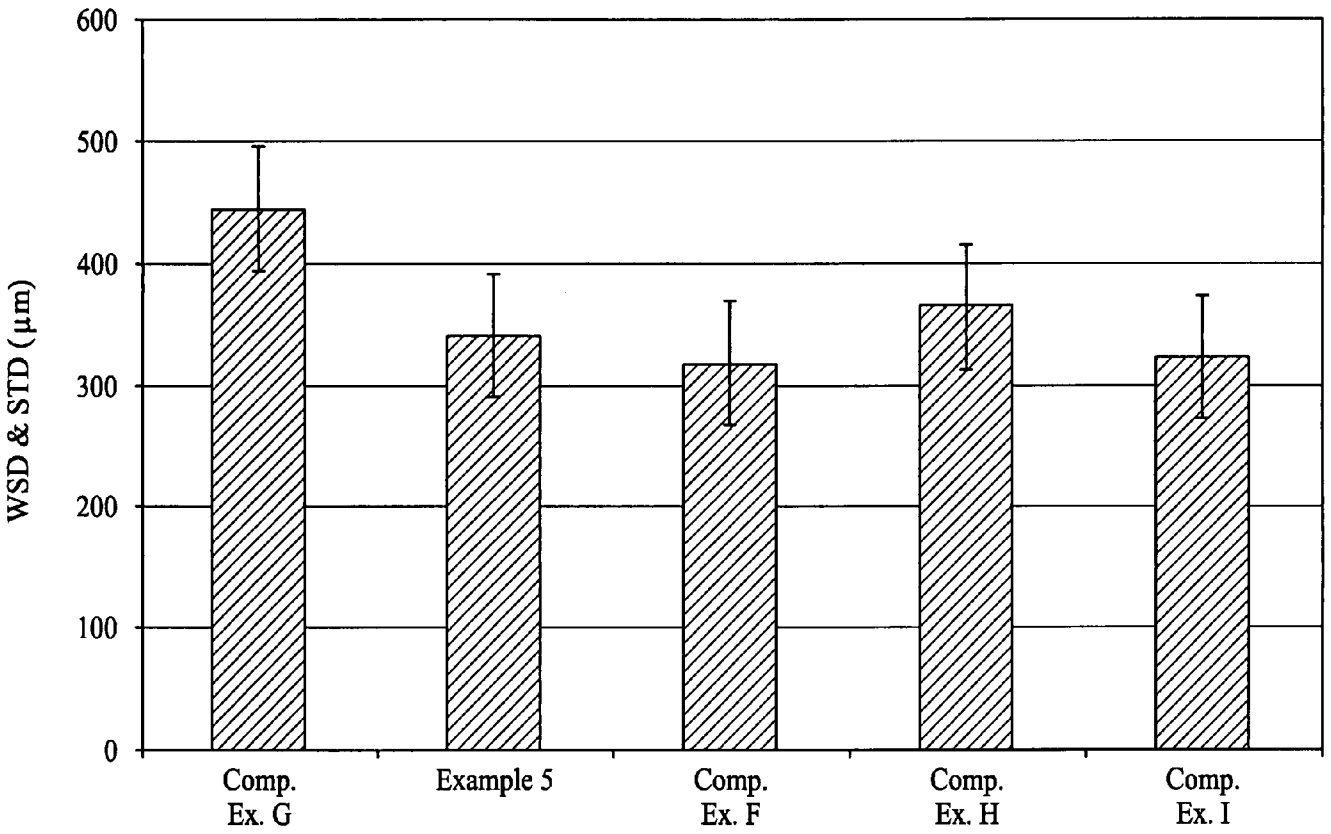
FIG. 2 is a bar graph comparing the wear performance of the lubricating oil composition of Example 5 versus the lubricating oil compositions of Comparative Examples F-I.

FIG. 2 shows a comparison of the WSDs and STDs as a function of titanium or zinc concentration for the lubricating oil composition of Example 5 and the lubricating oil compositions of Comparative Examples F-I. As the data show, the lubricating oil composition of Example 5 provided comparable and, in some instances, better wear performance to the lubricating oil composition of Comparative Example F, a premium diesel engine oil lubricant having a relatively high concentration of zinc dialkyldithiophosphate, and the lubricating oil compositions of Comparative Examples H and I each containing a zinc dialkyldithiophosphate.

Comparative Example J

A baseline lubricating oil formulation was formed containing 0.67 wt. % borated sulfonate detergent, 3.18 wt. % borated bis-succinimide prepared from a 1300 average molecular weight polyisobutylene, succinic anhydride, and a heavy polyamine, 1.73 wt. % ethylene carbonate post treated bis-succinimide prepared from a 2300 average molecular weight polyisobutylene succinic anhydride with a heavy polyamine, 2.91 wt. % polysuccinimide dispersant derived from terpolymer PIBSA, N-phenyl phenylenediamine, and polyetheramine, 5.3 wt. % dispersant viscosity index improver, 0.3 wt. % polyacrylate pour point depressant, 0.95 wt. % 250 TBN sulfurized calcium phenate detergent, 0.30 wt. % 17 TBN calcium sulfonate detergent, 0.40 wt. % 395 TBN magnesium sulfonate detergent, 0.30 wt. % diphenylamine antioxidant, 0.50 wt. % hindered phenol antioxidant, and 5 ppm silicone based foam inhibitor in a base oil containing 86 wt. % Chevron 100N base oil and 14 wt. % Chevron 220N base oil. The resulting baseline lubricating oil formulation had a phosphorus content of 0 wt. % and a sulfur content of 0.09 wt. %.

Comparative Example K

A baseline lubricating oil formulation was formed containing the same additives, base oil and treat rate, as in Comparative Example J. A secondary ZnDTP derived from derived from sec-butanol and methylisobutylcarbinol was formulated into this baseline lubricating oil formulation at 8 mM/kg. The resulting lubricating oil composition had a sulfated ash content of 0.70 wt. % as determined by ASTM D874, a phosphorus content of 0.66 wt. % and a sulfur content of 0.23 wt. %.

Comparative Example L

A baseline lubricating oil formulation was formed containing the same additives, base oil and treat rate, as in Comparative Example J. A secondary ZnDTP derived from derived from sec-butanol and methylisobutylcarbinol was formulated into this baseline lubricating oil formulation at 12 mM/kg. The resulting lubricating oil composition had a sulfated ash content of 0.70 wt. % as determined by ASTM D874, a phosphorus content of 0.065 wt. % and a sulfur content of 0.22 wt. %.

Comparative Example M

A baseline lubricating oil formulation was formed containing the same additives, base oil and treat rate, as in Comparative Example J. A secondary ZnDTP derived from derived from sec-butanol and methylisobutylcarbinol was formulated into this baseline lubricating oil formulation at 19 mM/kg. The resulting lubricating oil composition had a phosphorus content of 0.13 wt. % and a sulfur content of 0.34 wt. %.

Comparative Example N

A baseline lubricating oil formulation was formed containing the same additives, base oil and treat rate, as in Comparative Example J. A secondary ZnDTP derived from derived from sec-butanol and methylisobutylcarbinol was formulated into this baseline lubricating oil formulation at 26 mM/kg. The resulting lubricating oil composition had a sulfated ash content of 1.32 wt. % as determined by ASTM D874, a phosphorus content of 0.17 wt. % and a sulfur content of 0.44 wt. %.

Example 6

A baseline lubricating oil formulation was formed containing the same additives, base oil and treat rate, as in Comparative Example J. Titanium (IV) isopropoxide was formulated into this baseline lubricating oil formulation at 34 mM/kg. The resulting lubricating oil composition had a phosphorus content of 0 wt. % and a sulfur content of 0.087 wt. %.

Example 7

A baseline lubricating oil formulation was formed containing the same additives, base oil and treat rate, as in Comparative Example J. Titanium (IV) n-propoxide was formulated into this baseline lubricating oil formulation at 34 mM/kg. The resulting lubricating oil composition had a phosphorus content of 0 wt. % and a sulfur content of 0.087 wt. %.

Example 8

A baseline lubricating oil formulation was formed containing the same additives, base oil and treat rate, as in Comparative Example J. Titanium (IV) 2-ethylhexoxide was formulated into this baseline lubricating oil formulation at 34 mM/kg. The resulting lubricating oil composition had a phosphorus content of 0 wt. % and a sulfur content of 0.087 wt. %.

Example 9

A baseline lubricating oil formulation was formed containing the same additives, base oil and treat rate, as in Comparative Example J. Titanium 2-ethylhexoxide was formulated into this baseline lubricating oil formulation at 27 mM/kg. The resulting lubricating oil composition had a phosphorus content of 0 wt. % and a sulfur content of 0.087 wt. %.

Performance Testing

The lubricating oil compositions of Examples 6-9 and the lubricating oil compositions of Comparative Examples J-N were evaluated using a PCS Instruments Ltd., London UK, Mini-Traction Machine (MTM) bench test as discussed above. The results of this test is set forth below in Table 2, which shows a comparison of the wear scar diameter (WSD) and standard deviation (STD) as a function of titanium or zinc concentration for the lubricating oil compositions of Examples 6-9 versus the lubricating oil compositions of Comparative Examples J-N.

TABLE 2

| Ex./Comp. Ex. | WSD (μm) | STD (μm) |
|---|---|---|
| Example 6 | 342 | 34 |
| Example 7 | 390 | 42 |
| Example 8 | 326 | 14 |
| Example 9 | 321 | 16 |
| Comparative Ex. J | 496 | 11 |
| Comparative Ex. K | 496 | 27 |
| Comparative Ex. L | 392 | 37 |
| Comparative Ex. M | 350 | 13 |
| Comparative Ex. N | 325 | 16 |

Figure 3:
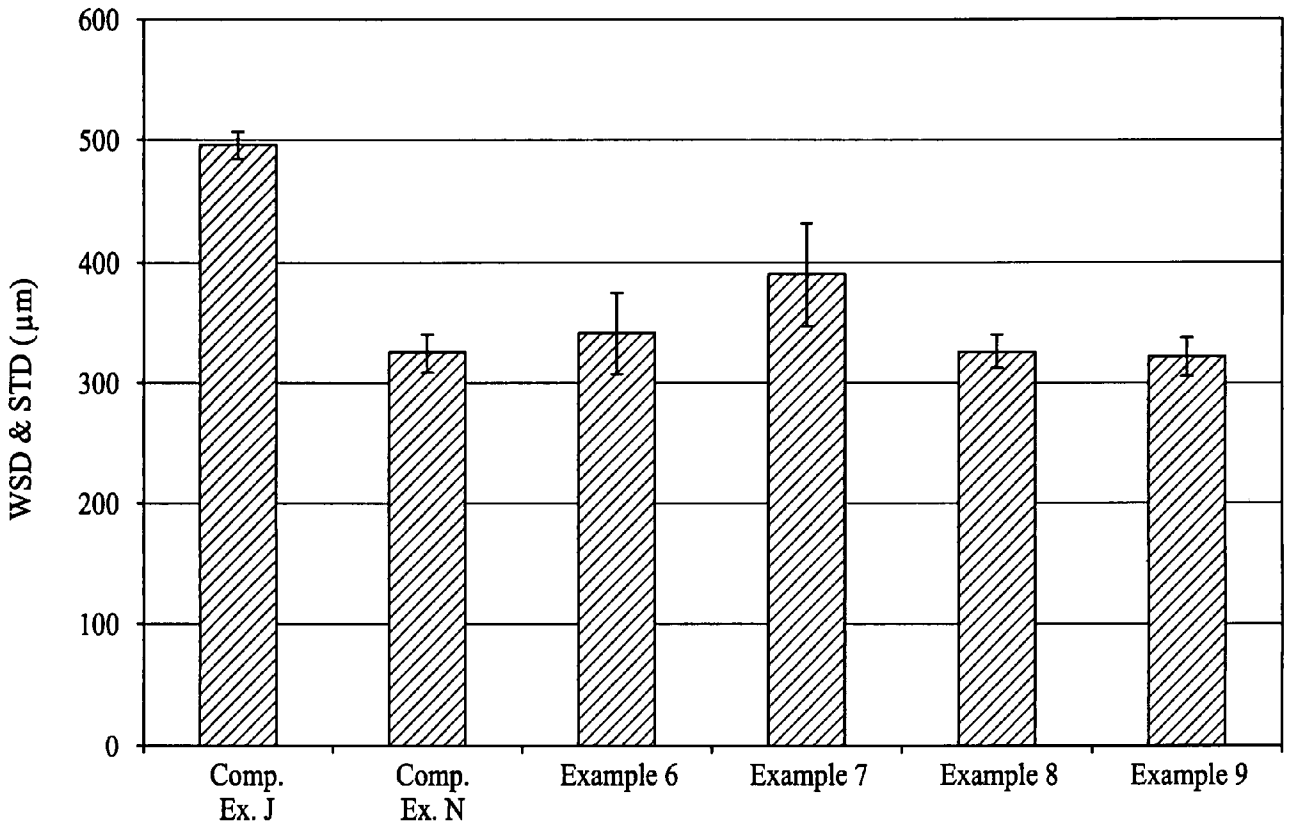
FIG. 3 is a bar graph comparing the wear performance of the lubricating oil composition of Examples 6-9 versus the lubricating oil compositions of Comparative Examples J and N.

FIG. 3 shows a comparison of the WSDs and STDs as a function of titanium or zinc concentration for the lubricating oil compositions of Examples 6-9 versus the lubricating oil compositions of Comparative Examples J and N. As the data show, the lubricating oil composition of Examples 6-9 provided comparable wear performance to the lubricating oil composition of Comparative Example N containing zinc dialkyldithiophosphate.

The lubricating oil compositions of Examples 6-9 and the lubricating oil compositions of Comparative Examples J and M were also analyzed for sulfated ash content, as measured by ASTM D874. The results are set forth below in Table 3:

TABLE 3

| | Comp. Ex. J | Comp. Ex. M | Ex. 6 | Ex. 7 | Ex. 8 | Ex. 9 |
|---|---|---|---|---|---|---|
| | 0.67 | 1.05 | 0.92 | 0.96 | 0.95 | 0.88 |
| | 0.65 | 1.06 | 0.93 | 0.96 | 0.94 | 0.89 |
| | 0.66 | 1.03 | 0.92 | 0.95 | 0.94 | 0.86 |
| | 0.66 | 1.01 | 0.94 | 0.92 | 0.92 | 0.88 |
| Average | 0.66 | 1.04 | 0.93 | 0.95 | 0.94 | 0.88 |
| STD* | 0.01 | 0.02 | 0.01 | 0.02 | 0.02 | 0.01 |

*Standard Deviation (STD)

As the data show, the lubricating oil compositions of Examples 6-9 had a lower sulfated ash content as compared to the lubricating oil composition of Comparative Example M containing a zinc dialkyldithiophosphate.

It will be understood that various modifications may be made to the embodiments disclosed herein. Therefore the above description should not be construed as limiting, but merely as exemplifications of preferred embodiments. For example, the functions described above and implemented as the best mode for operating the present invention are for illustration purposes only. Other arrangements and methods may be implemented by those skilled in the art without departing from the scope and spirit of this invention. Moreover, those skilled in the art will envision other modifications within the scope and spirit of the claims appended hereto.

What is claimed is:

1. A lubricating oil composition comprising (a) a major amount of an oil of lubricating viscosity; and (b) 1,680 ppm to about 11,132 parts per million (ppm) of Ti metal, based on the total weight of the composition, of an oil-soluble titanium compound of Formula I:

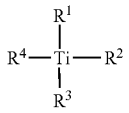

(I)

wherein $R^1$, $R^2$, $R^3$ and $R^4$ are independently a $C_1$-$C_8$ alkoxy group; wherein the lubricating oil composition is free of any zinc dialkyldithiophosphate and phosphorus content, and further wherein the lubricating oil composition has a sulfur content not exceeding 0.7 wt. %.

2. The lubricating oil composition of claim 1, wherein the oil of lubricating viscosity is comprised of a mineral base oil.

3. The lubricating oil composition of claim 1, wherein at least two of $R^1$, $R^2$, $R^3$ and $R^4$ are the same $C_1$-$C_8$ alkoxy group.

4. The lubricating oil composition of claim 1, wherein at least three of $R^1$, $R^2$, $R^3$ and $R^4$ are the same $C_1$-$C_8$ alkoxy group.

5. The lubricating oil composition of claim 1, wherein each of $R^1$, $R^2$, $R^3$, and $R^4$ are the same $C_1$-$C_8$ alkoxy group.

6. The lubricating oil composition of claim 1, wherein the oil-soluble titanium compound is selected from the group consisting of titanium methoxide, titanium ethoxide, titanium propoxide, titanium (IV) isopropoxide, titanium (IV) n-propoxide, titanium (IV) butoxide, titanium isobutoxide, titanium 4-methyl-2-pentoxide, titanium hexoxide, titanium pentoxide, titanium isopentoxide.

7. The lubricating oil composition of claim 1, which is free of any sulfur content.

8. The lubricating oil composition of claim 1, having a sulfated ash content of no more than about 1 wt. % as determined by ASTM D874.

9. The lubricating oil composition of claim 5, having a sulfated ash content of no more than about 1 wt. % as determined by ASTM D874.

10. The lubricating oil composition of claim 1, having a wear reducing property greater than or comparable to a corresponding lubricating oil composition in which the oil-soluble titanium compound in the lubricating oil composition is replaced with a zinc dialkyl dithiophosphate compound.

11. A method of reducing wear of metal parts in an internal combustion engine, the method comprising operating the engine with a lubricating oil composition comprising (a) a major amount of an oil of lubricating viscosity; and (b) 1,680 ppm to about 11, 132 ppm of Ti metal, based on the total weight of the composition, of an oil-soluble titanium compound of Formula I:

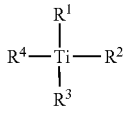

(I)

wherein $R^1$, $R^2$, $R^3$ and $R^4$ are independently a $C_1$-$C_8$ alkoxy group; wherein the lubricating oil composition is free of any zinc dialkyldithiophosphate and phosphorus content, and further wherein the lubricating oil composition has a sulfur content not exceeding 0.7 wt. %.

12. The method of claim 11, wherein the internal combustion engine is a compression ignition (diesel) engine.

13. The method of claim 12, wherein the compression ignition (diesel) engine is a heavy duty diesel (HDD) engine.

14. The method of claim 12, wherein the compression ignition (diesel) engine is equipped with at least one of an exhaust gas recirculation (EGR) system; a catalytic converter, and a particulate trap.

15. The method of claim 11, wherein at least two of $R^1$, $R^2$, $R^3$ and $R^4$ of the oil-soluble titanium compound are the same $C_1$-$C_8$ alkoxy group.

16. The method of claim 11, wherein at least three of $R^1$, $R^2$, $R^3$ and $R^4$ of the oil-soluble titanium compound are the same $C_1$-$C_8$ alkoxy group.

17. The method of claim 11, wherein each of $R^1$, $R^2$, $R^3$ and $R^4$ of the oil-soluble titanium compound are the same $C_1$-$C_8$ alkoxy group.

18. The method of claim 11, wherein the oil-soluble titanium compound is selected from the group consisting of titanium methoxide, titanium ethoxide, titanium propoxide, titanium (IV) isopropoxide, titanium (IV) n-propoxide, titanium (IV) butoxide, titanium isobutoxide, titanium 4-methyl-2-pentoxide, titanium hexoxide, titanium pentoxide, titanium isopentoxide, titanium (IV) 2-ethylhexoxide and mixtures thereof.

19. The method of claim 11, wherein the lubricating oil composition is free of any sulfur content.

20. The method of claim 11, wherein the lubricating oil composition has a sulfated ash content of no more than about 1 wt. % as determined by ASTM D874.

21. The method of claim 17, wherein the lubricating oil composition has a sulfated ash content of no more than about 1 wt. % as determined by ASTM D874.

22. The method of claim 11, wherein the lubricating oil composition has a wear reducing property greater than or comparable to a corresponding lubricating oil composition in which the oil-soluble titanium compound in the lubricating oil composition is replaced with a zinc dialkyl dithiophosphate compound.

23. An internal combustion engine lubricated with the lubricating oil composition of claim 1.

24. The internal combustion engine of claim 23, which is a compression ignition (diesel) engine.

25. The internal combustion engine of claim 24, wherein the engine is equipped with at least one of an EGR system; a catalytic converter; and a particulate trap.

26. The internal combustion engine of claim 23, which is a spark ignition engine.

27. An internal combustion engine lubricated with the lubricating oil composition of claim 5.

28. The internal combustion engine of claim 27, which is a compression ignition (diesel) engine.

29. The internal combustion engine of claim 28, wherein the engine is equipped with at least one of an EGR system; a catalytic converter; and a particulate trap.

30. The internal combustion engine of claim 27, which is a spark ignition engine.

* * * * *